US006592012B2

(12) United States Patent
Godshaw et al.

(10) Patent No.: US 6,592,012 B2
(45) Date of Patent: Jul. 15, 2003

(54) BACKPACK

(75) Inventors: Donald E. Godshaw, Evanston, IL (US); Andrezj Redzisz, Skokie, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/888,007

(22) Filed: Jun. 22, 2001

(65) Prior Publication Data

US 2002/0145018 A1 Oct. 10, 2002

Related U.S. Application Data

(60) Provisional application No. 60/213,402, filed on Jun. 23, 2000.

(51) Int. Cl.[7] ..... A45F 4/00

(52) U.S. Cl. ..... 224/153; 190/18 A; 190/115; 224/259; 224/261; 224/262; 224/627

(58) Field of Search ..... 224/153, 259, 224/261, 262, 627, 637, 648; 190/18 A, 115

(56) References Cited

U.S. PATENT DOCUMENTS

| | | | | |
|---|---|---|---|---|
| 5,588,569 A | * | 12/1996 | Mitomi et al. | 190/110 |
| 5,749,503 A | * | 5/1998 | Wulf et al. | 190/18 A |
| 5,893,495 A | * | 4/1999 | Godshaw et al. | 190/115 |
| 5,908,093 A | * | 6/1999 | Miyoshi | 190/115 |
| 5,927,798 A | * | 7/1999 | Ahn | 297/129 |
| 5,984,154 A | * | 11/1999 | Scicluna | 190/18 A |
| 6,279,706 B1 | * | 8/2001 | Mao | 16/113.1 |

* cited by examiner

*Primary Examiner*—Stephen K. Cronin
*Assistant Examiner*—Maerena W. Brevard
(74) *Attorney, Agent, or Firm*—Banner & Witcoff, Ltd.

(57) ABSTRACT

An improved convertible backpack construction is convertible from wheeled luggage to backpack and includes a back panel with a pocket for storing attachment belts and carrying straps.

14 Claims, 5 Drawing Sheets

FIG.6
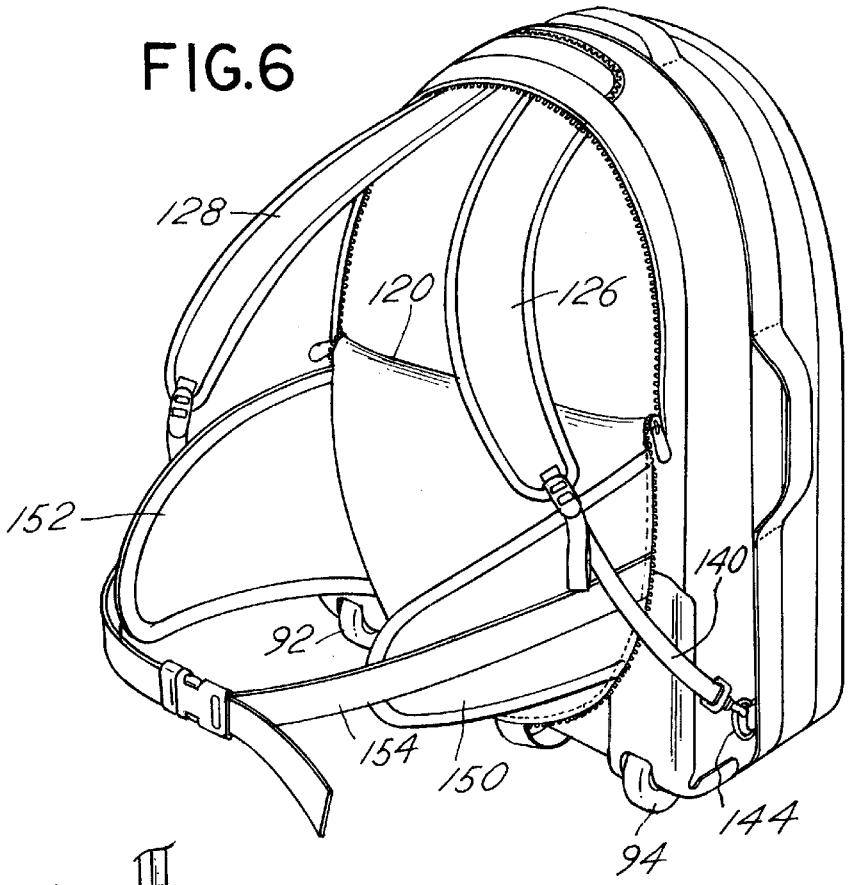
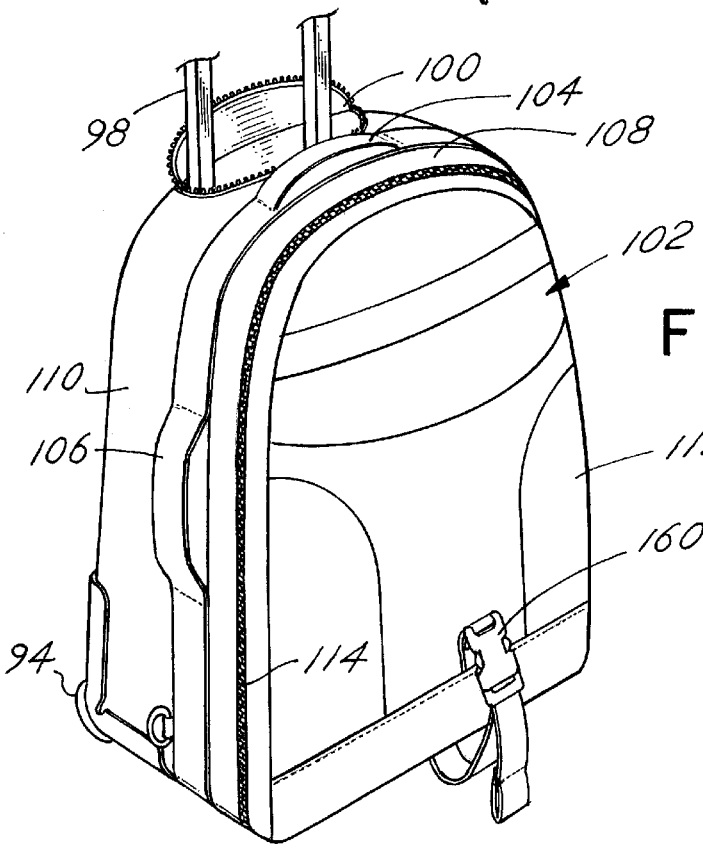
FIG.7

126
140
154
150
144

98
100
114
104
106

BACKPACK

CROSS REFERENCE TO RELATED APPLICATION

This is a utility application from Ser. No. 60/213,402 filed Jun. 23, 2000 entitled "Backpack" upon which we claim priority.

BACKGROUND OF THE INVENTION

In a principal aspect the present invention relates to a backpack carrying case and more particularly to a backpack that is convertible between luggage with handles, a wheeled carrying case and a backpack.

Campers, students and others often use backpacks to carry gear, books, and other equipment. On various occasions it is inappropriate or not convenient to carry such items as a backpack. In such instances, for example, it may be more appropriate to carry items either as a regular carrying case by means of a handle or as a wheeled case. Thus there has developed a need for a luggage item that is convertible so may be carried or transported by various means or modes including as a backpack.

SUMMARY OF THE INVENTION

Briefly, the present invention comprises a backpack that includes a back panel with an enclosure mounted thereon and a telescoping handle mounted so that it projects upwardly from the top of the backpack. Various handles may be attached to the sides of the backpack. The backside of the backpack includes a zippered enclosure in which backpack straps are stored. The backside of the backpack further includes a storage flap that may be folded outwardly to reveal a belt construction as well as an optimal back cushion. The backpack further includes wheels along the lower edge of the back panel. The described construction may be utilized as a backpack, as wheeled luggage, or as hand carried luggage.

Thus it is an object of the invention to provide an improved luggage construction.

It is a further object of the invention to provide an improved luggage construction that is convertible between a backpack configuration and a wheeled luggage construction.

Another object of the invention is to provide a backpack construction which is easily carried, and that is rugged and economical.

These and other objects, advantages, and features of the invention will be set forth in the detailed description which follows.

BRIEF DESCRIPTION OF THE DRAWING

In the detailed description that follows, reference will be made to the drawing comprised of the following figures:

FIG. 6 is an isometric view of the backpack luggage of FIG. 5 wherein the back straps as well as waist straps have been connected together for support and use of the backpack in the backpack configuration;

FIG. 7 is an isometric view of the backpack luggage as viewed from the front side thereof.

DESCRIPTION OF THE PREFERRED EMBODIMENTS

Figure 1:
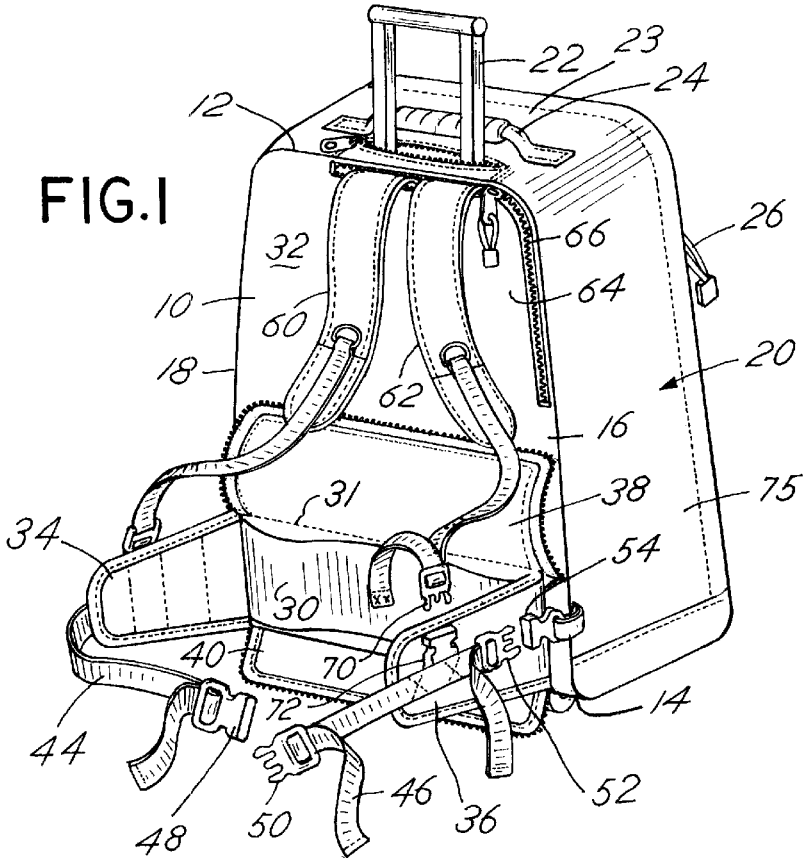
FIG. 1 is an isometric view of the backpack luggage viewed from the backside thereof with various straps exposed.
Figure 2:
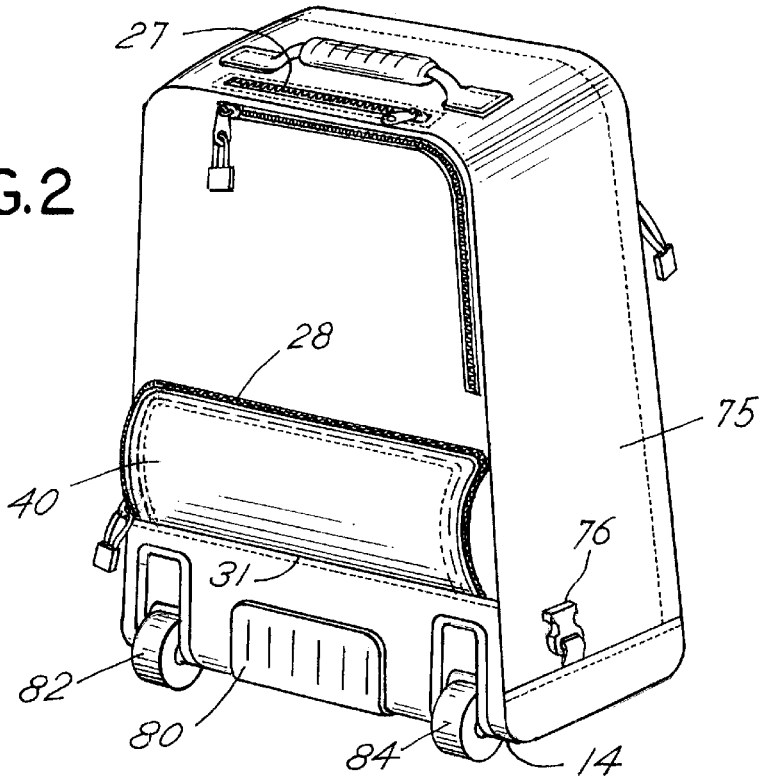
FIG. 2 is an isometric view of the backpack luggage of FIG. 1 with the backpack straps stored.
Figure 3:
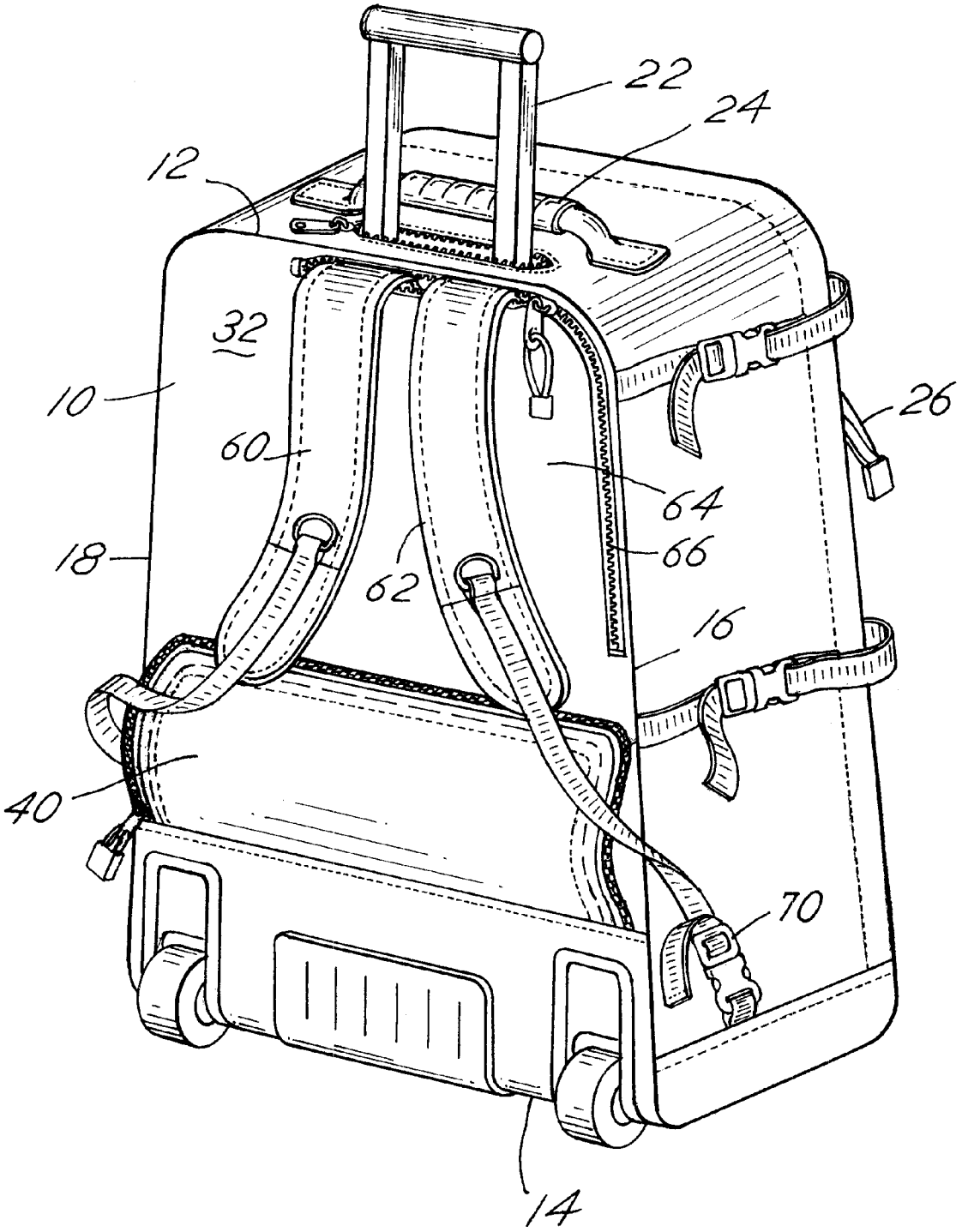
FIG. 3 is an isometric view of the backpack luggage of FIGS. 1 and 2 wherein the backpack straps have been connected in an alternate manner to the sides of the backpack.
Figure 4:
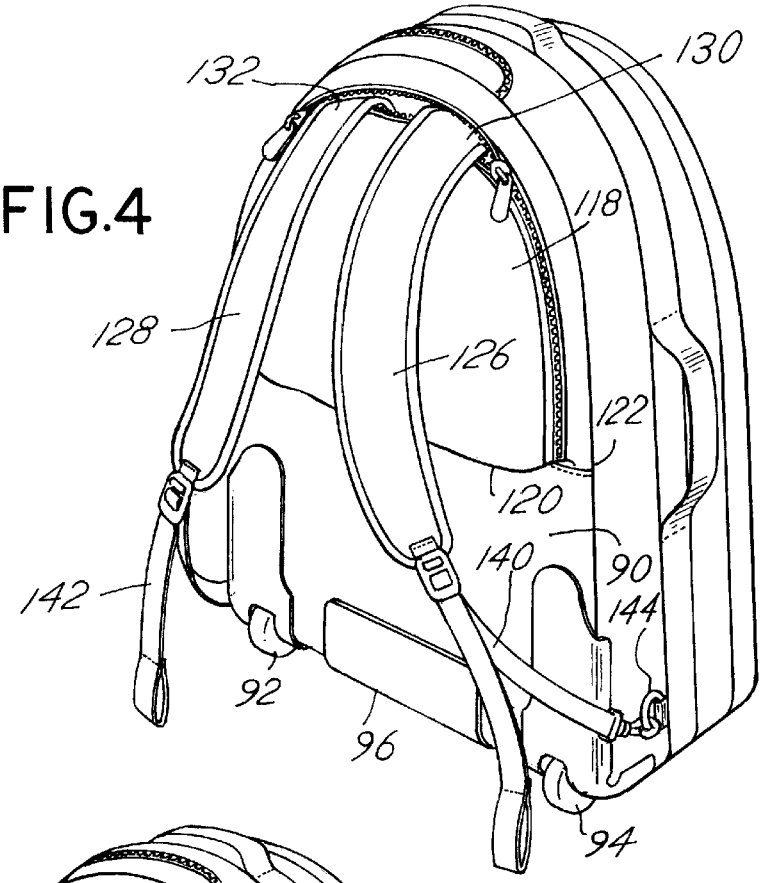
FIG. 4 is an isometric view of an alternative embodiment of the invention as viewed from the backside wherein shoulder straps have been removed from a storage pocket.

Referring to the figures, the backpack luggage embodiment of FIGS. 1–3 includes a generally rigid, planar, back panel 10 having a top edge 12, a bottom edge 14, a first side edge 16 and a second side edge 18. The edges 12, 14, 16 and 18 define a generally rectangular or generally trapezoidal shape with top edge 12 and bottom edge 14 generally parallel. Other shapes are possible, but the disclosed shape is preferred, inasmuch as it fits comfortably against the back of a user carrying the backpack. Top edge 12 may, for example, be arcuately shaped.

An enclosure 20 with a topside 23 is affixed to the back panel 10 on the front side thereof. A telescopic handle 22 is fitted against the panel 10 on the inside of the enclosure 20 and is retained within the enclosure 20. The telescopic handle 22 may be extended or retracted into the enclosure 20. A hand carrying handle 24 is also provided on the top side 23 enclosure 20. Additional handles, similar to the top handle 24, may be provided on the front or other portions or sides of the backpack enclosure 20. Enclosure 20 is typically a flexible, bag-like enclosure; however, one or more sides thereof may be formed by a rigid panel. A zipper flap access panel forming the outside or front of enclosure 20 and operated by means of a zipper 26 is provided for access to the interior of the enclosure 20.

A lumbar cushion 30 is attached to the back side surface 32 of the back panel 10 adjacent the lower edge 14. Cushion 30 is mounted on a flexible flap 40 that is attached to back panel 10 along a fold line 31 extending between side edges 16, 18 (see FIG. 2). Flap 40 fits over pocket 38 and may be attached to panel 10 by a fastener such as a Velcro fastener or zipper to store the cushion 30 and flaps 34, 36 described below. The lumbar cushion 30 is configured to fit against the lower back torso of a person carrying the backpack on their shoulders. Thus, the cushion 30 is shaped to fit against the back of a person and is also made from a cushioning material, such as sponge rubber, which facilitates maintaining the backpack in position by someone who is carrying the backpack as shown in FIG. 1. Cushion 30 is on the inside of flap 40 and is exposed as shown in FIG. 1 when flap 40 is released from pocket 38 on panel 10.

A first side flap 34 is an extension of flap 40 along side edge 18. A second retaining side flap 36 is an opposite extension of flap 40 outwardly of side edge 16. The flaps 34 and 36 are made from flexible or semi-rigid material and each flap 34 and 36 folds inwardly over panel 40 parallel to the respective side edge 18 and 16 and fits against and over the lumbar cushion 30 when flap 40 is closed over pocket 38.

The foldable retaining flap system comprising an upper flap pocket 38 and a lower flap 40 thus retain the side flaps 34 and 36 when the backpack is being used in a configuration without backpack carrying straps (FIG. 2). That is, the flaps 34 and 36 may be folded against the cushion 30 and retained by the flaps 40 which folds over and fasten by fasteners such as Velcro strip fasteners.

When unfolded and in use, the side flaps 34 and 36 include belt straps 44 and 46 with buckles 48 and 50 that fit around the waist of a person to help hold the backpack in position. The straps 44 and 46 are thus adjustable in length. The straps 44 and 46 may include buckle members, such as buckle member 52 at the inner end of the strap 46, which cooperate with a retaining buckle 54 to facilitate the connection of the flap 36 and to provide extra support when supporting the backpack upon the back of a person carrying the backpack luggage.

Shoulder straps, which are adjustable in length, comprise a first and a second shoulder strap 60 and 62 retained and stored in a pocket 64 in back panels closed by a zipper 66. Each strap 60 and 62 includes a buckle, such as buckle 70 for strap 62, which cooperates with a buckle element 72 on associated flap 36 so that the back support straps 60 and 62 can be placed over the shoulders of a person carrying the backpack luggage and effectively connected at each end to back panel 10. When the straps 60 and 62 are not being utilized, they are stored in the pocket 64 and the zipper 66 is in the closed position such as depicted in FIG. 2. Similarly, the telescoping handle 22 is maintained in a zippered enclosure defined by and enclosed by the zipper 27. The flap 40 may also be closed by means of a zipper, for example, zipper 28 in FIG. 2, or by means of fasteners, such as Velcro-type fasteners. Additional buckles, such as buckles 76, may be provided on the lateral sides 75 of the enclosure 20 for connection with an associated buckle 70 of an adjustable strap 62 as an alternative connection for strap 62.

A wheel housing 80 is integrated into the lower edge 14 of the back panel 10. The housing 80 supports wheels 82 and 84. The backpack luggage may then be carried and used as a typical wheeled luggage item by extension of the telescoping handle 22 and storage of the various straps as previously described.

FIGS. 4 through 9 illustrate an alternative embodiment of the invention. In this alternative embodiment the luggage item may also be utilized as a backpack or as a wheeled luggage item which is a wheeled case with a telescoping handle or alternatively as a luggage merely movable or transportable by means of handles on the sides of the luggage item.

Figures 8, 9:
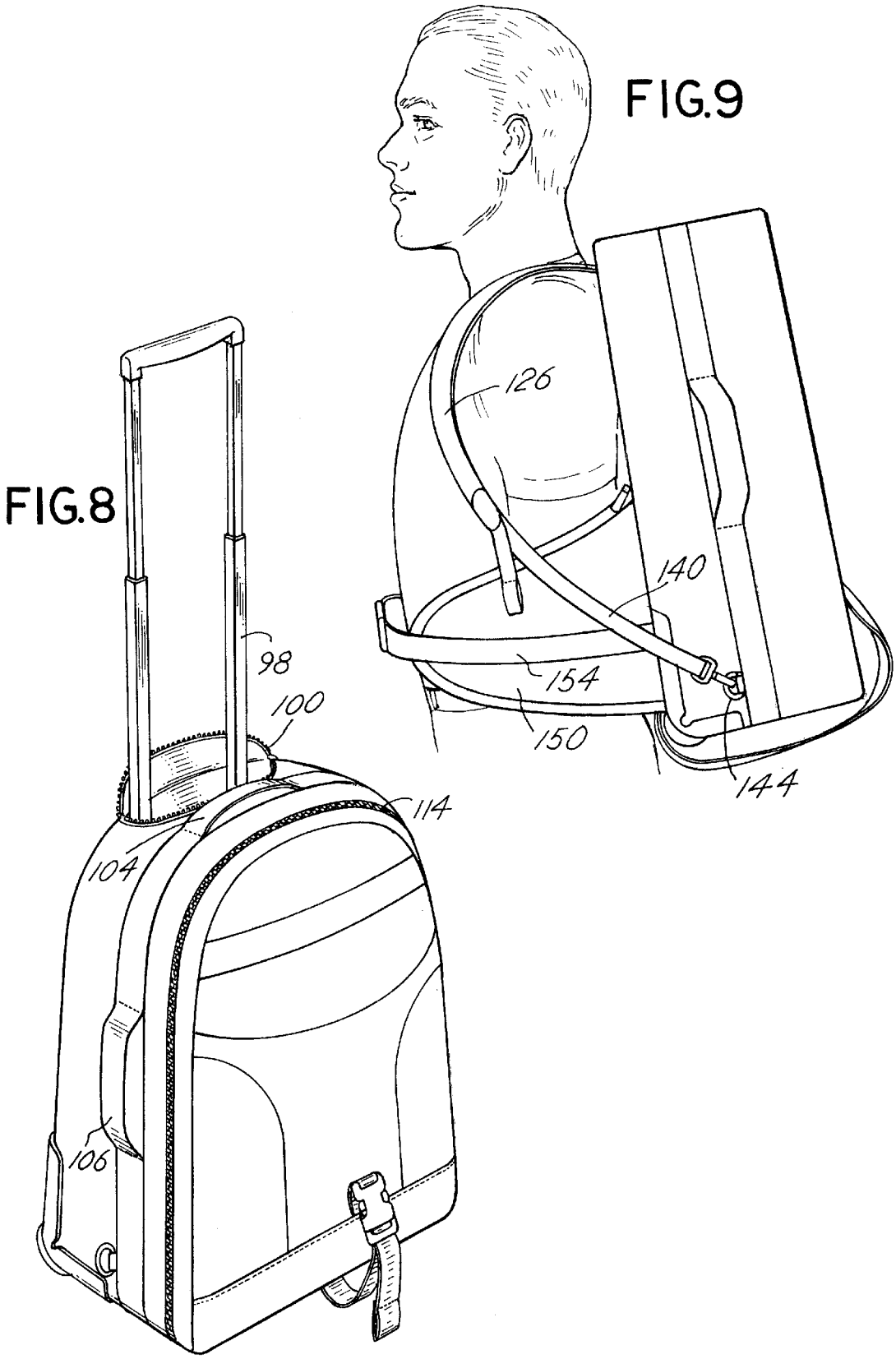
FIG. 8 is an isometric front view of the backpack luggage of FIG. 7 wherein a telescoping handle has been extended.
FIG. 9 is a schematic side view illustrating the manner of use of the backpack straps to support the backpack.

Referring therefore to FIGS. 4–9, the luggage item comprises a back panel 90 that is generally rigid as in the first embodiment of FIGS. 1–3. Wheels 92 and 94 are provided along a lower edge 96 of the back panel 90. A telescoping handle 98 shown in FIGS. 7 and 8 is fastened on the inside of the back panel 90 and may be extended through a zippered opening 100 so that the luggage item may be transported via use of the wheels 92, 94. The back panel 90 includes an enclosure 102 mounted thereon or attached thereto for carrying various items such as books, clothing, etc. The shape of the enclosure 102 is generally parallelpiped although in the embodiment depicted the upper side of the enclosure 102 is arcuate. Handles 104 and 106 are provided along the topside 108 and lateral side 110 of the enclosure 102. Thus the telescoping handle 98 may be placed within the zippered opening 100 and the luggage carried as traditional luggage by means of handles 104 or 106. The enclosure 102 includes a front flap 112 which may be attached to the sides of the enclosure by means of a zippered fastener 114 for example. In any event, two modes of utilization of the luggage namely, as regular luggage carried by handles 104 and 106 or as a wheeled case movable on the wheels 92, 94 by pulling the telescoping handle 98 are depicted.

The luggage item may be easily converted to a full backpack also. That is, referring to FIG. 4 there is illustrated a flexible flap 118 which is attached by a living hinge 120 extending between lateral sides 122 and 124 of the back panel 90. The panel flap 118 defines a pocket into which shoulder straps 126 and 128 may be fitted. The shoulder straps 126, 128 are attached at their respective upper ends 130 and 132 within the zippered pocket defined by the flap 118. The shoulder straps 126 and 128 include, respectively, strap extensions 140, 142 that are adjustable. The strap extensions 140 and 142 are attached by buckles or ring attachments such as ring attachment 144 respectively to opposite sides of the enclosure 102. In this manner, the shoulder straps 126 and 128 are adjustable in length and may be fitted over the shoulder of a person wishing to carry the item as a backpack.

Figure 5:
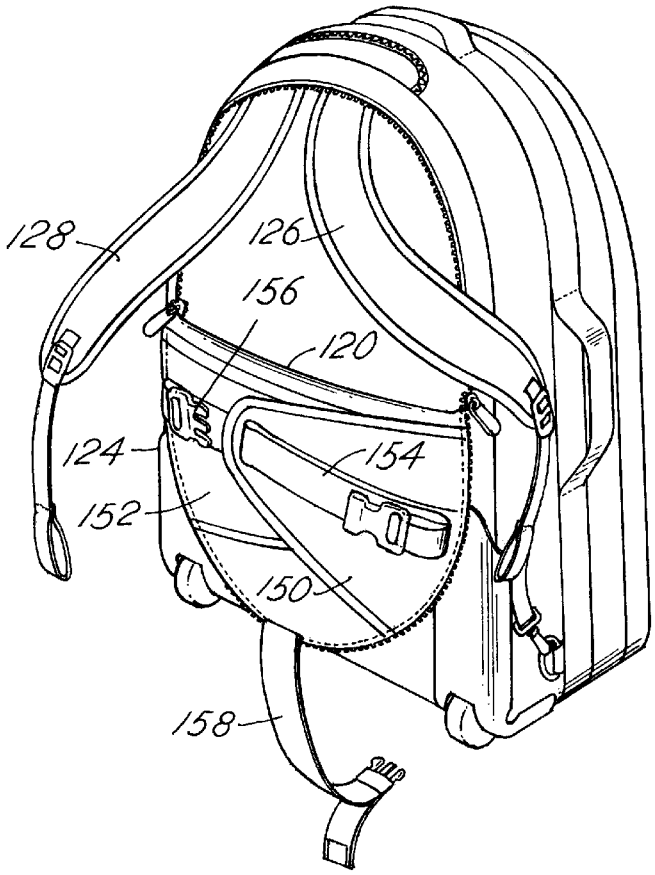
FIG. 5 is an isometric view of the embodiment of FIG. 4 wherein a storage pocket has been released to reveal a belt or waist strap construction for use in combination with backpack straps.

Additionally as shown in FIGS. 5 and 6, the pocket defined by the flap 118 includes on the inside thereof a first flap extension 150 and the second flap extension 152 with buckle straps 154 and 156 incorporated therein. Also a downwardly extending retention strap 158 is connected to the buckle 160 on the front panel 112 as shown in FIG. 7. This serves to retain the flap 118 in an adjusted position about the hinge connection 120.

The backpack may then be carried on the back of an individual in the manner illustrated in FIG. 9. That is, straps such as strap 126 may be fitted over the shoulder and attached to the connector 144. The side flap 150 and more particularly the side extension strap 154 may be fitted about the waist of an individual and connected to the straps 152, 156 on the opposite side of the luggage item to hold the backpack in position about the waist of a person. The strap 158 that is attached to the front panel 112 of the luggage item holds the luggage item and more particularly the flap 118 in the appropriate orientation or position so that the luggage item will be in proper balance when carried. Multiple adjustments can thus be made using the straps and flaps as described to ensure appropriate comfort and balance. Further, the inside of the flap 118 may include a lumbar support configuration or pad (not shown) similar to that depicted in FIG. 1 that will further facilitate the comfort of carrying the luggage backpack.

While preferred embodiments have been disclosed, the invention is limited only by the following claims are equivalents thereof.

What is claimed is:

1. Backpack luggage comprising in combination:

a generally planar, rigid back panel, said back panel having a back side and a front side, a top edge, a bottom edge, a first side edge and a spaced second side edge;

an enclosure attached to the front side of the back panel;

a retaining flap on the back side of the back panel foldable about a fold line extending between the first and second side edges, said flap having an inside face and an outside face, said flap including a back cushion on the inside face, said cushion being stored by folding the retaining flap inside face against the back side of the back panel; and the backside of the back panel including retaining straps attached thereto, at least some of said retaining straps foldable against the cushion for storage by the retaining flap when folded.

2. The construction of claim 1 further including wheels attached to the luggage construction at the bottom edge of the back panel, said retaining flap being foldable to an open position which extends over the bottom edge to shield the wheels when the retaining flap is open.

3. The construction of claim 1 further including shoulder straps extending from the top edge of the back panel connectable to the backside of the back panel for carriage of the construction as a backpack.

4. The construction of claim 1 further including a telescoping handle attached to the front side of the back panel and extendable telescopically upwardly from the top edge.

5. The construction of claim 1 including a first side strap on the first side of the back side and a second side strap on the second side of the back side, said first and second side straps being connectable to form a backpack retention belt.

6. Backpack luggage comprising, in combination:

a generally planar, rigid back panel having a back side and a front side, a top edge, a bottom edge, a first side edge, and a spaced second side edge;

an enclosure attached to the front side of the back panel;

first and second back straps extending from the top edge of the back panel downwardly;

a retaining flap on the back side of the back panel foldable about a fold line extending between the first and second edges of the back panel against the back panel to provide a retaining pocket;

a first strap connector and a second strap connector affixed to the back side of the back panel, said first and second connectors being retained by the retaining flap when said retaining flap is folded against the back panel;

said first and second strap connectors attachable to the first and second back straps respectively to provide means for carrying the back pack.

7. The construction of claim 6 further including a lumbar cushion affixed to the back panel intermediate the first and second connectors.

8. Backpack luggage comprising in combination a generally planar, rigid back panel, said back panel having a back side and a front side, a top edge, a bottom edge, a first side edge, and a spaced second side edge;

an enclosure attached to the front side of the back panel;

a retaining flap on the back side of the back panel foldable about a fold line extending between the first and second side edges, said flap having an inside face and an outside face, said flap including a back cushion on the inside face, said cushion being stored by folding the retaining flap inside face against the back side of the back panel; and a first side strap on the first side of the back side and a second side strap on the second side of the back side, said first and second side straps being connectable to form a backpack retention belt.

9. The construction of claim 8 having at least one of the first side strap and said second side strap foldable against the cushion for storage by the retaining flap when folded.

10. The construction of claim 8 further including wheels attached to the luggage construction at the bottom edge of the back panel, said retaining flap being foldable to an open position which extends over the bottom edge to cover the wheels when the retaining flap is open.

11. The construction of claim 8 further including shoulder straps extending from the top edge of the back panel connectable to the back side of the back panel for carriage of the luggage as a backpack.

12. The construction of claim 8 further including a telescoping handle attached to the front side of the back panel and extendable telescopically upwardly from the top edge.

13. Backpack luggage comprising in combination:

a generally planar, rigid back panel, said back panel having a back side and a front side, a top edge, a bottom edge, a first side edge and a spaced second side edge;

an enclosure attached to the front side of the back panel and wherein said back panel further includes retaining straps attached thereto, at least one of said retaining straps foldable against the cushion for storage by the retaining flap when folded against the back panel;

a retaining flap on the back side of the back panel foldable about a fold line extending between the first and second side edges, said flap having an inside face and an outside face, said back panel back side including a lumbar cushion attached thereto, said flap being foldable to cover said cushion and store said cushion therein by attachment of said retaining flap against the cushion and the back panel.

14. The construction of claim 13 further including a first side strap on the first side of the back side and a second side strap on the second side of the back side, said first and second side straps being connectable to form a backpack retention belt.

* * * * *